US012653238B2

(12) United States Patent
Long et al.

(10) Patent No.: US 12,653,238 B2
(45) Date of Patent: Jun. 16, 2026

(54) HEATING ASSEMBLY, ELECTRONIC VAPORIZATION APPARATUS, AND METHOD FOR PREPARING HEATING ASSEMBLY

(71) Applicant: SHENZHEN SMOORE TECHNOLOGY LIMITED, Shenzhen (CN)

(72) Inventors: Jicai Long, Shenzhen (CN); Hongming Zhou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 379 days.

(21) Appl. No.: 18/349,874

(22) Filed: Jul. 10, 2023

(65) Prior Publication Data

US 2023/0346028 A1 Nov. 2, 2023

Related U.S. Application Data

(63) Continuation of application No. PCT/CN2021/136168, filed on Dec. 7, 2021.

(30) Foreign Application Priority Data

Jan. 13, 2021 (CN) ..... 202110044127.3

(51) Int. Cl.

| | |
|---|---|
| ***A24F 40/46*** | (2020.01) |
| ***A24F 40/10*** | (2020.01) |
| ***A24F 40/51*** | (2020.01) |

(52) U.S. Cl.
CPC ..... *A24F 40/46* (2020.01); *A24F 40/10* (2020.01); *A24F 40/51* (2020.01)

(58) Field of Classification Search
None
See application file for complete search history.

(56) References Cited

U.S. PATENT DOCUMENTS

2020/0315251 A1* 10/2020 Ding ..... A24F 40/46

FOREIGN PATENT DOCUMENTS

| | | | |
|---|---|---|---|
| CN | 105693287 | A | 6/2016 |
| CN | 107173849 | A | 9/2017 |
| CN | 107182139 | A | 9/2017 |
| CN | 108451045 | A | 8/2018 |

(Continued)

OTHER PUBLICATIONS

European Patent Office, Search Report in European Patent Application No. 21919065.9 (Jun. 17, 2024).

(Continued)

*Primary Examiner* — Cynthia Szewczyk
(74) *Attorney, Agent, or Firm* — Leydig, Voit & Mayer, Ltd.

(57) ABSTRACT

A heating assembly includes: a porous ceramic substrate for guiding a to-be-vaporized substrate; and a heating layer for heating and vaporizing the to-be-vaporized substrate. The heating layer includes a porous structure. The heating layer is partially filled in the porous ceramic substrate. In an embodiment, a portion of the heating layer is filled in the porous ceramic substrate along a thickness direction, and an other portion thereof is disposed outside the porous ceramic substrate.

12 Claims, 6 Drawing Sheets

(56) References Cited

FOREIGN PATENT DOCUMENTS

| | | | | | |
|---|---|---|---|---|---|
| CN | 110074463 | A | | 8/2019 | |
| CN | 110447962 | A | | 11/2019 | |
| CN | 110680023 | A | | 1/2020 | |
| CN | 210203364 | U | | 3/2020 | |
| CN | 111109666 | A | | 5/2020 | |
| CN | 112315039 | A | * | 2/2021 | ..... A24F 40/46 |
| CN | 112888093 | A | | 6/2021 | |
| WO | 2017066955 | A1 | | 4/2017 | |
| WO | 2020238607 | A1 | | 12/2020 | |

OTHER PUBLICATIONS

Patent Cooperation Treaty, International Search Report and Written Opinion, International Application No. PCT/CN2021/136168 (Mar. 2, 2022).

Chinese Patent Office, Office Action in Chinese Patent Application No. 202110044127.3 (Mar. 3, 2022).

* cited by examiner

HEATING ASSEMBLY, ELECTRONIC VAPORIZATION APPARATUS, AND METHOD FOR PREPARING HEATING ASSEMBLY

CROSS-REFERENCE TO PRIOR APPLICATION

This application is a continuation of International Patent Application No. PCT/CN2021/136168, filed on Dec. 7, 2021, which claims priority to Chinese Patent Application No. 202110044127.3, filed on Jan. 13, 2021. The entire disclosure of both applications is hereby incorporated by reference herein.

FIELD

This application relates to the field of vaporizer technologies, and specifically, to a heating assembly, an electronic vaporization apparatus, and a method for preparing a heating assembly.

BACKGROUND

Porous materials generally have the advantages of low relative density, high specific strength, high specific surface area, light weight, and good permeability. The electromagnetic and high thermal conductivity features of a metal make porous metal materials have good application value in functional fields of sensor, electromagnetic shielding, electrode material and heat exchange. The characteristics of high temperature resistance, corrosion resistance, good air permeability, good biocompatibility and good environmental compatibility make the porous ceramic materials have important application value in fields of fluid filtration, catalyst carriers and adsorption materials, especially in electronic vaporization apparatuses.

Currently, ceramic vaporization core structures used in an electronic vaporization apparatus may be classified into two types: First, a heating wire is wound around or a heating mesh is embedded in a porous ceramic substrate, and second, a dense resistance heating thick film is sintered on the porous ceramic substrate. Because the heating wire or the heating film of the two ceramic vaporization core structures has a certain height and a dense structure, and infiltrability between a metal and a to-be-vaporized substrate is relatively poor, in a working process, the to-be-vaporized substrate cannot completely infiltrate the surface of the heating wire or the heating film, and such phenomena as dry burning, carbon deposition and pore plugging, and burning smell occur, which seriously affects mouthfeel of the electronic vaporization apparatus.

SUMMARY

In an embodiment, the present invention provides a heating assembly, comprising: a porous ceramic substrate configured to guide a to-be-vaporized substrate; and a heating layer configured to heat to vaporize the to-be-vaporized substrate, wherein the heating layer comprises a porous structure, and wherein the heating layer is partially filled in the porous ceramic substrate.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
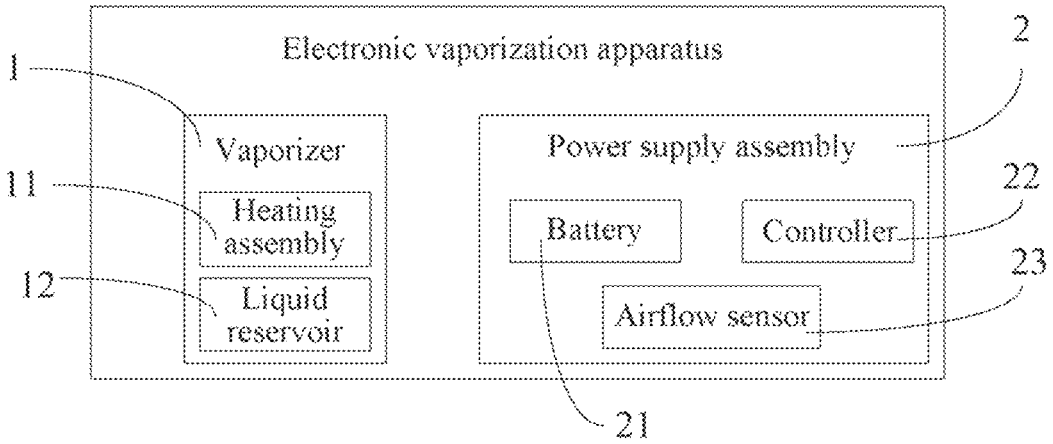
FIG. 1 is a schematic structural diagram of an electronic vaporization apparatus according to this application.

In an embodiment, the present invention provides a heating assembly, an electronic vaporization apparatus, and a method for preparing a heating assembly, so as to resolve the technical problem in the prior art that infiltrability between a metal layer of a ceramic vaporization core and a to-be-vaporized substrate is relatively poor.

In an embodiment, the present invention provides a heating assembly, including: a porous ceramic substrate and a heating layer; where the porous ceramic substrate is configured to guide a to-be-vaporized substrate; the heating layer is configured to heat to vaporize the to-be-vaporized substrate; and where the heating layer is a porous structure; and the heating layer is partially filled in the porous ceramic substrate.

A portion of the heating layer is filled in the porous ceramic substrate along the thickness direction, and the other portion thereof is disposed outside the porous ceramic substrate.

The thickness of the portion of the heating layer that is disposed outside the porous ceramic substrate is 1-15 μm; and the thickness of the portion of the heating layer that is filled into the porous ceramic substrate by is 30-200 μm.

A portion of the heating layer in the porous ceramic substrate is filled in a pore formed in the porous ceramic substrate, and a portion thereof is attached to the pore wall of the pore formed in the porous ceramic substrate.

The porosity of the heating layer is 20%-60%.

The heating layer includes one or more of a metal, an alloy, and a conductive ceramic.

The porosity of the porous ceramic substrate is 40%-75%, and the average pore size of the porous ceramic substrate is 10-40 μm.

The heating assembly further includes two electrodes disposed at an interval on the porous ceramic substrate and configured to connect the heating layer to a battery; and the resistance values of both the two electrodes are less than 0.1Ω.

The resistance value of the heating assembly is 0.5Ω-2.0Ω.

To resolve the foregoing technical problems, the second technical solution provided in this application is as follows: An electronic vaporization apparatus is provided, including: a heating assembly, where the heating assembly is the heating assembly according to any one of the foregoing.

To resolve the foregoing technical problems, the third technical solution provided in this application is as follows: A method for preparing a heating assembly is provided, including: obtaining a porous ceramic substrate; and forming a heating layer having a porous structure on the surface of the porous ceramic substrate; where the heating layer is specifically sintered by using a conductive slurry, and the heating layer is partially filled in the porous ceramic substrate.

The conductive slurry includes a conductive powder and an organic carrier, the conductive powder includes one or more of a metal, an alloy, and a conductive ceramic, and the organic carrier includes a main solvent, a thickener, a flow control agent, and a surfactant.

The percentage of the conductive powder to the total mass of the conductive slurry is 50%-90%, and the percentage of the organic carrier to the total mass of the conductive slurry is 10%-50%; and the viscosity of the conductive slurry is 10000 Pa·S-1000000 Pa·S.

The percentage of the main solvent to the total mass of the organic carrier is 70%-90%, the percentage of the thickener to the total mass of the organic carrier is 0.5%-20%, the percentage of the flow control agent to the total mass of the organic carrier is 0.1%-10%, and the percentage of the surfactant to the total mass of the organic carrier is 0%-5%.

D50 (median particle size) of the conductive powder is not greater than 5 μm.

The sintering temperature is 700-1500° C.

Beneficial effects of this application are as follows: Different from the prior art, the heating assembly in this application includes a porous ceramic substrate and a heating layer. The porous ceramic substrate is configured to guide a to-be-vaporized substrate, the heating layer is configured to heat to vaporize the to-be-vaporized substrate, the heating layer is a porous structure, and a portion of the heating layer is filled in the porous ceramic substrate. The heating layer is disposed as a porous structure, and the heating layer is partially filled in the porous ceramic substrate, to improve infiltrability of the porous ceramic substrate and the heating layer, so that the to-be-vaporized substrate contacts the heating layer more fully, which helps the heating layer transfer heat to the to-be-vaporized substrate around the heating layer in a timely manner, increases an aerosol amount, avoids phenomena such as dry burning, carbon deposition, and burning smell, and improves user experience.

The following further describes this application in detail with reference to the accompanying drawings and embodiments. It is particularly noted that the following embodiments are merely used to describe this application, but do not limit the scope of this application. Similarly, the following embodiments are merely some rather than all of the embodiments of this application, and all other embodiments obtained by a person of ordinary skill in the art without creative efforts shall fall within the protection scope of this application.

The terms "first", "second", and "third" in this application are merely intended for a purpose of description, and shall not be understood as an indication or implication of relative importance or implicit indication of the number of indicated technical features. Therefore, features defining "first", "second", and "third" can explicitly or implicitly include at least one feature. In description of this application, "multiple" means at least two, such as two and three unless it is specifically defined otherwise. All directional indications (for example, up, down, left, right, front, back . . . ) in the embodiments of this application are only used for explaining relative position relationships, movement situations, or the like between the various components in a specific posture (as shown in the accompanying drawings). If the specific posture changes, the directional indications change accordingly. In the embodiments of this application, the terms "include", "have", and any variant thereof are intended to cover a non-exclusive inclusion. For example, a process, method, system, product, or device that includes a series of steps or units is not limited to the listed steps or units, but further optionally includes a step or unit that is not listed, or further optionally includes another step or component that is intrinsic to the process, method, product, or device.

Embodiment mentioned in the specification means that particular features, structures, or characteristics described with reference to the embodiment may be included in at least one embodiment of this application. The term appearing at different positions of this specification may not refer to the same embodiment or an independent or alternative embodiment that is mutually exclusive with another embodiment. A person skilled in the art explicitly or implicitly understands that the embodiments described in the specification may be combined with other embodiments.

FIG. 1 is a schematic structural diagram of an electronic vaporization apparatus according to this application.

The electronic vaporization apparatus may be configured for vaporization of a liquid substrate and the like. The electronic vaporization apparatus includes a vaporizer 1 and a power supply component 2 that are connected to each other.

The vaporizer 1 includes a heating assembly 11 and a liquid reservoir 12. The liquid reservoir 12 is configured to store a to-be-vaporized substrate. The heating assembly 11 is configured to heat to vaporize the to-be-vaporized substrate in the liquid reservoir 12 to form an aerosol that can be inhaled by a user. The vaporizer 1 may be specifically configured to vaporize the to-be-vaporized substrate and generate an aerosol, so as to be used in different fields, for example, a medical or an electronic aerosolization apparatus. In a specific embodiment, the vaporizer 1 may be applied to an electronic aerosolization apparatus and configured to vaporize the to-be-vaporized substrate and generate an aerosol to be inhaled by a user. This example is used in all the embodiments below. Certainly, in other embodiments, the vaporizer 1 may also be applied to a hair spray device to vaporize hair spray used for hair styling; or the vaporizer is applied to a medical device for treating diseases of upper and lower respiratory systems so as to vaporize medical drugs.

The power supply assembly 2 includes a battery 21, a controller 22, and an airflow sensor 23. The battery 21 is configured to supply power to the vaporizer 1, so that the vaporizer 1 can vaporize a liquid substrate to form an aerosol. The controller 22 is configured to control the vaporizer 1 to work. The airflow sensor 23 is configured to detect a change of airflow in the electronic vaporization apparatus to start the electronic vaporization apparatus.

The vaporizer 1 and the power supply assembly 2 may be integrally arranged or detachably connected, which is designed according to specific requirements.

Figure 2:
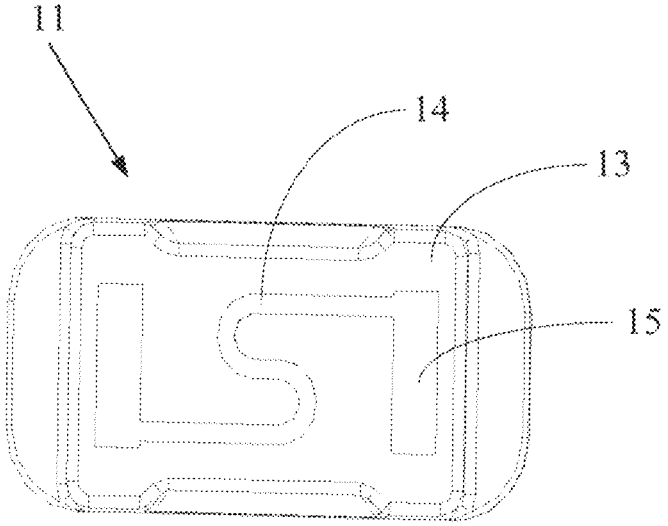
FIG. 2 is a schematic structural diagram of a heating assembly according to this application.

FIG. 2 is a schematic structural diagram of a heating assembly according to this application.

The heating assembly 11 includes a porous ceramic substrate 13 and a heating layer 14. The heating layer 14 is attached to the porous ceramic substrate 13, and the heating layer 14 is a porous structure. The porous ceramic substrate 13 contacts the to-be-vaporized substrate from the liquid reservoir 12, and guides the to-be-vaporized substrate to the heating layer 14 by using a capillary force, and the heating layer 14 vaporizes the to-be-vaporized substrate to form an aerosol. That is, the porous ceramic substrate 13 is configured to guide the to-be-vaporized substrate, and the heating layer 14 is configured to heat the to-be-vaporized substrate. The heating layer 14 includes one or more of a metal, an alloy, and a conductive ceramic, and only the heating layer 14 is needed to implement heating and vaporization of the to-be-vaporized substrate. The heating layer 14 is partially filled in the porous ceramic substrate 13.

By disposing the heating layer 14 in the heating assembly 11 as a porous structure, advantages such as low relative density, high specific strength, high specific surface area, light weight, and good permeability of the porous material can be used. Further, the heating layer 14 is partially filled in the porous ceramic substrate 13, that is, the heating layer 14 and the porous ceramic substrate 13 are combined into a whole, so that the to-be-vaporized substrate flows into the heating assembly 11, and is guided to the heating layer 14 by the porous ceramic substrate 13 in the heating assembly 11. By using porous performance of the heating layer 14, the to-be-vaporized substrate almost completely infiltrates the heating layer 14, so as to improve infiltrability of the to-be-vaporized substrate to the heating layer 14, and provide sufficient e-liquid, so as to avoid phenomena such as dry burning, carbon deposition and pore blocking, and burning smell of the heating assembly 11, and improve mouthfeel of the electronic vaporization apparatus. During heating and vaporization, the heating layer 14 may transfer heat to a surrounding to-be-vaporized substrate for vaporization in a timely manner. The amount of smoke is large, and the surface temperature is relatively low. In the process of vaporizing the to-be-vaporized substrate, the content of a harmful substance caused by high-temperature decomposition is greatly reduced, and the phenomenon of carbon deposition and pore blocking is also greatly reduced. This can effectively improve suction experience, improve safety of the electronic vaporization apparatus, and prolong the service life thereof.

Figure 3:
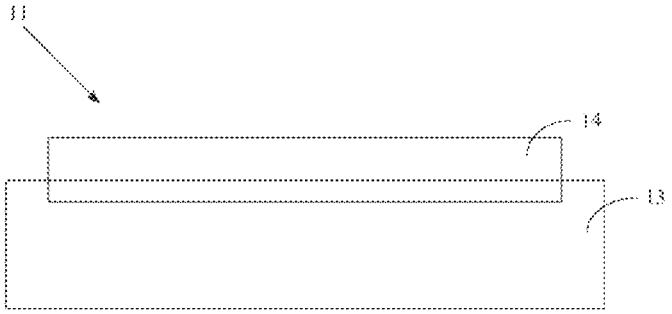
FIG. 3 is a schematic cross-sectional diagram of an implementation of a heating assembly according to this application.
Figure 4:
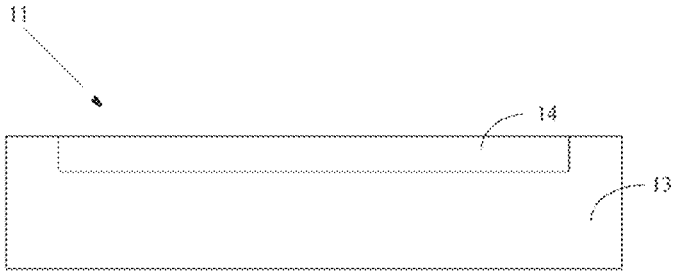
FIG. 4 is a schematic cross-sectional diagram of another implementation of a heating assembly according to this application.

It may be understood that the heating layer 14 may be partially filled in the porous ceramic substrate 13, and the other portion thereof may be disposed outside the porous ceramic substrate 13. Alternatively, the entire heating layer 14 may be filled in the porous ceramic substrate 13. That is, in an implementation, a portion of the heating layer 14 is filled in the porous ceramic substrate 13 along the thickness direction of the heating layer 14, and the other portion thereof is disposed outside the porous ceramic substrate 13. For a specific structure, refer to FIG. 3 (FIG. 3 is a schematic cross-sectional diagram of an implementation of a heating assembly according to this application). In another implementation, the heating layer 14 is completely filled in the porous ceramic substrate 13 along the thickness direction thereof, one surface of the heating layer 14 is flush with one surface of the porous ceramic substrate 13, and the thickness of the heating layer 14 is less than the thickness of the porous ceramic substrate 13. For a specific structure, refer to FIG. 4 (FIG. 4 is a schematic cross-sectional diagram of another implementation of the heating assembly according to this application). Specific arrangement manners of the heating layer 14 and the porous ceramic substrate 13 are selected according to needs.

Specifically, the thickness of the portion that is of the heating layer 14 and that is filled in the porous ceramic substrate 13 is 30-200 μm, and the thickness of the portion that is of the heating layer 14 and that is disposed outside the porous ceramic substrate 13 is 1-15 μm. The thickness of the heating layer 14 that is higher than the surface of the porous ceramic substrate 13 is relatively small, and after the to-be-vaporized substrate arrives at the surface of the porous ceramic substrate 13, the distance for climbing to the heating layer 14 is shortened, thereby facilitating infiltrating the heating layer 14 by the to-be-vaporized substrate. Because the porous ceramic substrate 13 has many pores, and a morphology of the porous ceramic substrate 13 is irregular, the thickness of the heating layer 14 penetrated into the porous ceramic substrate is 30-200 μm. This helps the porous ceramic substrate 13 to form good mechanical engagement with the heating layer 14, so that thermal shock resistance of the porous ceramic substrate 13 in a working process is improved, and the heating layer 14 is not easily separated from the porous ceramic substrate 13. The material of the heating layer 14 that is filled in the porous ceramic substrate 13 is partially filled in a pore formed in the porous ceramic substrate 13, to enhance bonding strength between the heating layer 14 and the porous ceramic substrate 13. The other portion is attached to the pore wall of the pore formed in the porous ceramic substrate 13, so as to prevent the porous ceramic substrate 13 from being blocked by the infiltrated heating layer 14, thereby causing a decrease in the liquid storage amount of the porous ceramic substrate 13. In addition, a channel is provided, so that the to-be-vaporized substrate can quickly reach the surface of the heating layer 14, thereby providing a timely e-liquid supply effect. That is, instead of partially embedding the heating layer 14 in a groove formed on the surface of the porous ceramic substrate 13, the material of the heating layer 14 that is filled in the porous ceramic substrate 13 is combined with the material of the porous ceramic substrate 13.

Figure 5:
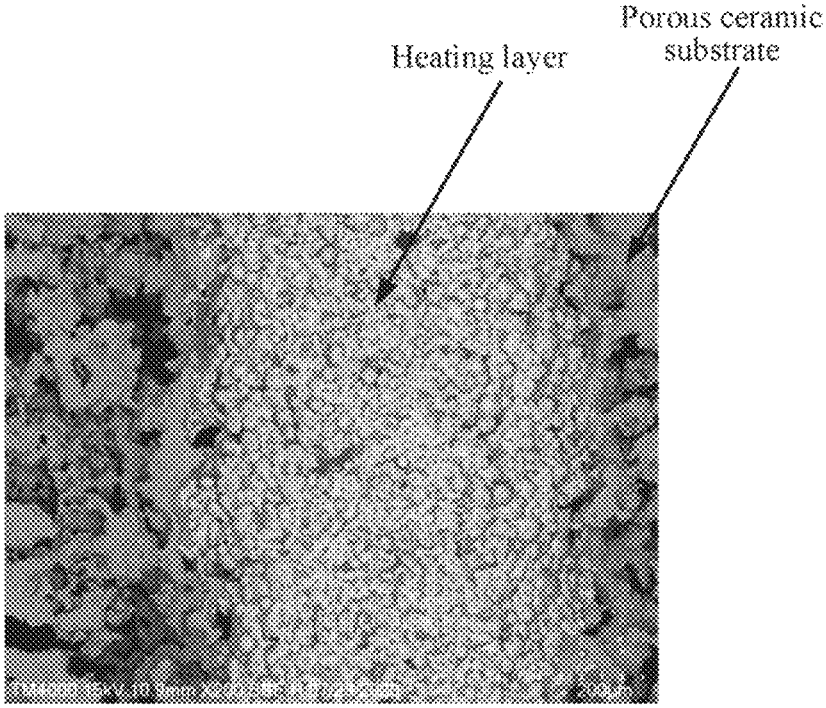
FIG. 5 is a microscopic morphology diagram of the surface of a heating assembly in the prior art under a scanning electron microscope.
Figure 6:
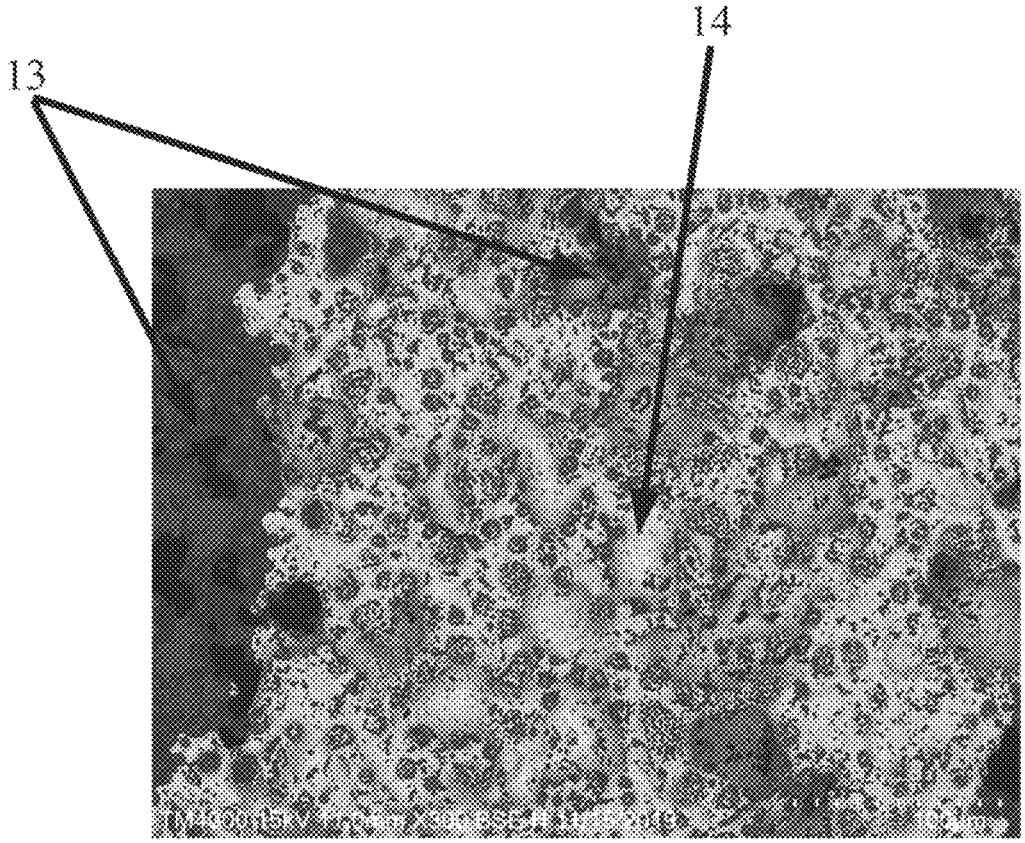
FIG. 6 is a microscopic morphology diagram of the surface of a heating assembly according to this application.

FIG. 5 is a microscopic morphology diagram of the surface of a heating assembly in the prior art under a scanning electron microscope, and FIG. 6 is a microscopic morphology diagram of the surface of a heating assembly according to this application under a scanning electron microscope.

The porosity of the heating layer 14 is 20%-60%. Referring to FIG. 5, in the prior art, a conductive metal of a heating layer (by using T29 as an example) in the heating assembly is a dense material, a region, in which the heating layer is disposed, on the porous ceramic substrate completely covers the conductive metal, and no exposed porous ceramic substrate is observed. However, according to the heating assembly 11 provided in this application, referring to FIG. 6, under a 300-time scanning electron microscope, the porosity of the heating layer 14 is set to 20%-60%, so that a large quantity of irregular pores exist in the heating layer 14, and the exposed porous ceramic substrate 13 can be directly observed through some pores. After the to-be-vaporized substrate infiltrates the porous ceramic substrate 13, the to-be-vaporized substrate may wet the surface of the heating layer 14 along an exposed pore on the heating layer 14. When the heating assembly 11 works, a relatively high temperature caused by a lack of e-liquid on the surface of the heating layer 14 can be avoided, generation of peculiar smell such as burning smell is reduced, and the content of aldehydes and ketones in the aerosol is reduced. Therefore, safety is good. In addition, the to-be-vaporized substrate around the heating layer 14 is sufficient, and the heating layer 14 can transmit energy to the to-be-vaporized substrate near the heating layer 14 in a timely manner, which helps increase the amount of aerosols.

Because the heating layer 14 is attached to the porous ceramic substrate 13 in a manner of drying and sintering of a resistance slurry, the porosity of the porous ceramic substrate 13 is set to 40%-75%, the average pore size of the porous ceramic substrate 13 is set to 10-40 μm, and compressive strength is between 50 N-500 N. The porosity of the porous ceramic substrate 13 is not less than 40%, so as to ensure that the porous ceramic substrate 13 can store enough to-be-vaporized substrates for vaporization. If the porosity is too low, it easily causes e-liquid shortage and dry burning. The porosity of the porous ceramic substrate 13 is not higher than 75%, to ensure that the porous ceramic substrate 13 has sufficient strength. A higher porosity indicates a lower strength of the porous ceramic substrate 13, and cannot meet an assembly requirement. In addition, a higher porosity indicates that too many to-be-vaporized substrates are stored, and liquid leakage is more likely. The average pore size of the porous ceramic substrate 13 is greater than 10 μm, so as to ensure that the resistance slurry can smoothly flow into pores formed on the porous ceramic substrate 13, instead of being filled in the pores on the surface of the porous ceramic substrate 13, which prevents the heating layer 14 from penetrating into the structure of the porous ceramic substrate 13. However, the average pore size of the porous ceramic substrate 13 is less than 40 μm, so as to prevent excessive penetration of the resistance slurry into the porous ceramic substrate 13, thereby causing a waste of the resistance slurry. In addition, a large pore size also tends to cause a large amount of resistance slurry on the surface of the porous ceramic substrate 13 to flow into pores. The surface of the porous ceramic substrate 13 is covered insufficiently, and the resistance value does not meet a requirement. Continuity of the heating layer 14 formed after the resistance slurry and the porous ceramic substrate 13 are sintered is relatively poor, and stability of a resistor in the working process is relatively poor.

It may be understood that the heating assembly 11 further includes two electrodes 15 disposed at an interval on the porous ceramic substrate 13, and is configured to connect the heating layer 14 to the battery 21, that is, one end of the electrode 15 is connected to the heating layer 14, and the other end thereof is connected to the battery 21. The electrodes 15 are connected to the heating layer 14 to form a complete resistor device. The controller 22 controls, according to a detection result of the airflow sensor 23, the battery 21 whether to supply power to the heating layer 14. After the battery 21 supplies power to the heating layer 14, the heating layer 14 starts to work. The resistance values of the two electrodes 15 are both less than 0.1Ω, so as to avoid heating of the electrodes 15 as far as possible, causing an energy waste, and preventing damage to a component of the electrodes 15 and the heating layer 14 in contact therewith. Bonding strength between the electrodes 15 and the porous ceramic substrate 13 is greater than or equal to 5 MPa, so as to prevent the electrodes 15 from falling off the porous ceramic substrate 13, prolong the service life of the heating assembly 11, and further improve performance of the electronic vaporization apparatus.

Figure 7:
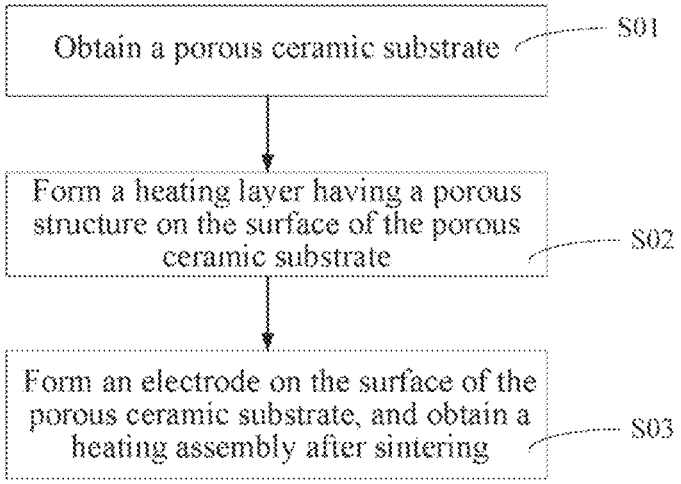
FIG. 7 is a schematic diagram of a preparation procedure of a heating assembly according to this application.
Figure 8:
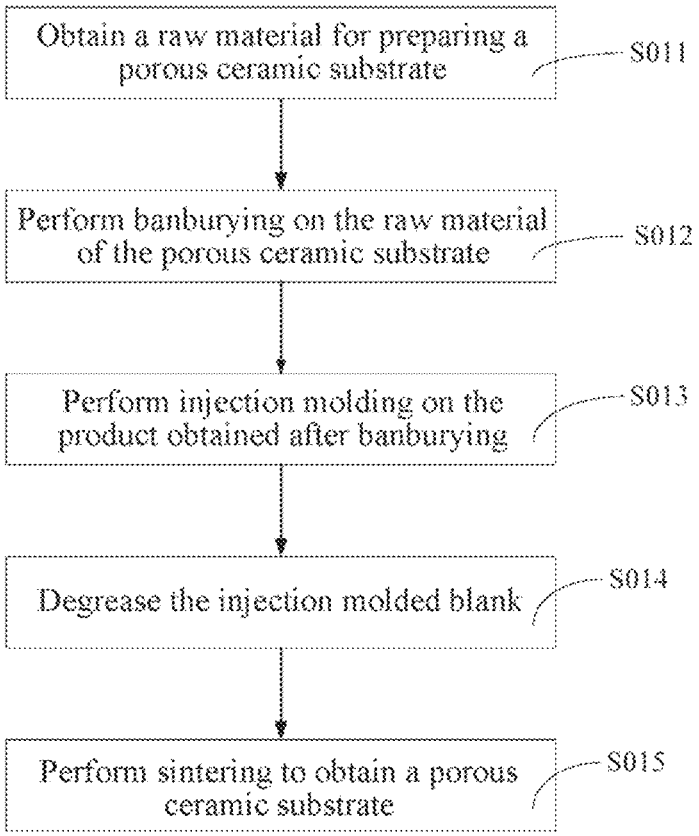
FIG. 8 is a schematic diagram of a preparation procedure of a porous ceramic substrate in a heating assembly according to this application.
Figure 9:
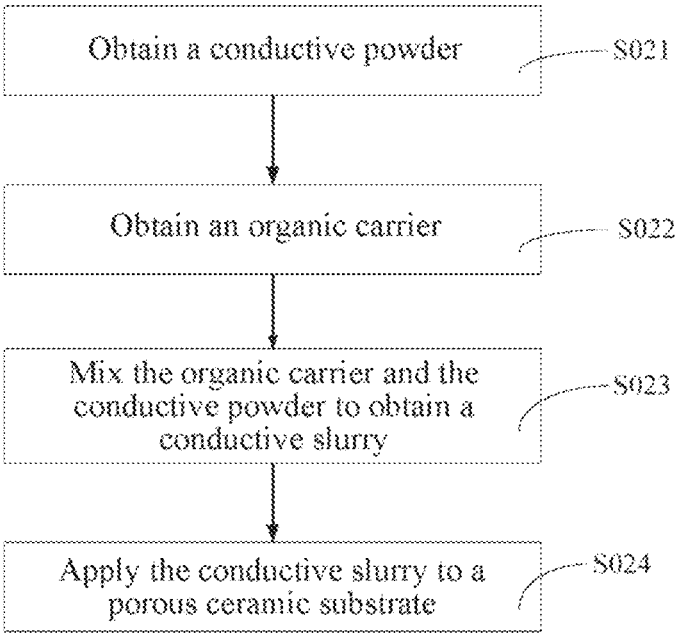
FIG. 9 is a schematic diagram of a preparation procedure of a heating layer in a heating assembly according to this application.

FIG. 7 is a schematic diagram of a preparation process of a heating assembly according to this application, FIG. 8 is a schematic diagram of a preparation process of a porous ceramic substrate in a heating assembly according to this application, and FIG. 9 is a schematic diagram of a preparation process of a heating layer in a heating assembly according to this application.

A method for preparing the heating assembly 11 includes:

S01: Obtain a porous ceramic substrate.

A ceramic powder is prepared and the porous ceramic substrate 13 is made by sintering. Specifically, a method for preparing the porous ceramic substrate 13 includes:

S011: Obtain a raw material for preparing a porous ceramic substrate.

The raw material for preparing the porous ceramic substrate 13 includes a ceramic powder and an organic carrier. The ceramic powder includes but is not limited to aluminum oxide, calcium oxide, silicon oxide, magnesium oxide, and sodium oxide. The organic carrier includes but is not limited to paraffin, polypropylene, polyethylene, vegetable oil, oleic acid, microcrystalline wax, beeswax, and stearic acid. The mass percentage of the ceramic powder to the total mass of the porous ceramic substrate 13 is 40%-68%.

In an implementation, the ceramic powder consists of 5%-15% aluminum oxide, 5%-30% calcium oxide, 20%-60% silicon oxide, 5%-20% magnesium oxide, and 1%-15% sodium oxide. The organic carrier consists of 40%-65% paraffin, 5%-30% microcrystalline wax, 5%-15% beeswax, 5%-20% polyethylene, 5%-20% polypropylene, and 1%-10% stearic acid. The percentage is mass percentage.

S012: Perform banburying on the raw material of the porous ceramic substrate.

Adjust the temperature of an internal mixer to 60-180 degrees, add 10-80 parts by weight of the organic carrier into a mixer chamber for banburying, and add 100 parts by weight of the ceramic powder into the mixer chamber for banburying. Close the mixer chamber after 20-60 minutes. It may be understood that the organic carrier and the ceramic powder are added to the mixer chamber in equal fractions. The temperature and mixing time of the internal mixer may be selected as needed.

S013: Perform injection molding on the product obtained after banburying.

The product obtained after banburying from step S012 is cooled and crushed to obtain an injection material. The injection material is added to a hopper, and a formed blank is obtained by using an injection molding machine. The process conditions are below: The mold temperature is 12-50 degrees, the injection temperature is 110-200 degrees, and the injection pressure is 10-100 Mpa.

S014: Degrease the injection molded blank.

Move the injection molded blank in step S013 into a degreasing furnace, first raise the temperature of the degreasing furnace to 160-250 degrees at the rate of 0.5-4 degrees per minute, and keep the temperature for 1-4 hours; increase the temperature to 250-450° C. at the rate of 0.5-5 degrees per minute and keep the temperature for 1-3 hours; increase the temperature to 600° C. at the rate of 1-3 degrees per minute and keep the temperature for 2-3 hours; and finally cool it to the room temperature.

S015: Perform sintering to obtain a porous ceramic substrate.

The blank obtained by degreasing in step S014 is heated at stages to a sintering temperature of 850-1250 degrees at different heating rates of 0.5-5 degrees per minute, held for 1-6 hours at this temperature, and sintered under the normal pressure. It may be understood that in the heating process at stages, heating rates at each stage are the same. The furnace is cooled to obtain the porous ceramic substrate 13.

S02: Form a heating layer having a porous structure on the surface of the porous ceramic substrate.

Specifically, the heating layer 14 having a porous structure is formed on the surface of the porous ceramic substrate 13, the heating layer 14 is specifically sintered by using a conductive slurry, and the heating layer 14 is partially filled in the porous ceramic substrate 13. The preparation method includes:

S021: Obtain a conductive powder.

Functional phase raw materials of the conductive powder include one or more of conductive metals, alloys, or conductive ceramics such as Ag, Pd, Pt, Au, Ru, Ni, Cu, Ti, RuO2, and TiB2. The functional phase raw materials are mixed to obtain a conductive powder, where D50 (median particle size) of the conductive powder is less than or equal to 5 μm. The D50 of the conductive powder is controlled to be less than 5 microns because the conductive powder has a small volume and a light mass. Therefore, the conductive powder is more easily attached to the pore wall of a pore formed in the porous ceramic substrate 13, which is more conducive to forming the heating assembly 11 provided in this application.

S022: Obtain an organic carrier.

The organic carrier includes a main solvent, a thickener, a flow control agent, and a surfactant, and the main solvent, the thickener, the flow control agent, and the surfactant are mixed homogeneously to obtain the organic carrier. The main solvent is one or more of terpineol, tributyl citrate, butyl carbitol, and butyl carbitol acetate; the thickener is ethyl cellulose; the flow control agent is one or more of hydrogenated castor oil and polyamide wax; and the surfactant is one or more of polyvinyl butyral, span-85, and lecithin. The main solvent accounts for 70-90% of the total mass of the organic carrier, the thickener accounts for 0.5%-20% of the total mass of the organic carrier, the flow control agent accounts for 0.1%-10% of the total mass of the organic carrier, and the surfactant accounts for 0-5% of the total mass of the organic carrier. The main solvent, the thickener, the flow control agent, and the surfactant in the organic carrier and their proportions are selected as required.

S023: Mix the organic carrier and the conductive powder to obtain a conductive slurry.

The percentage of the conductive powder in the total mass of the conductive slurry is 50%-90%, and the percentage of the organic carrier in the total mass of the conductive slurry is 10%-50%. The viscosity of the conductive slurry is 10000 Pa·S-1000000 Pa·S, the viscosity test instrument is AMETEK BROOKFIELD DV3THBCJ0, the rotor is CPA-52Z, and the rotation speed is 1 RPM.

S024: Apply the conductive slurry to a porous ceramic substrate.

Figure 10:
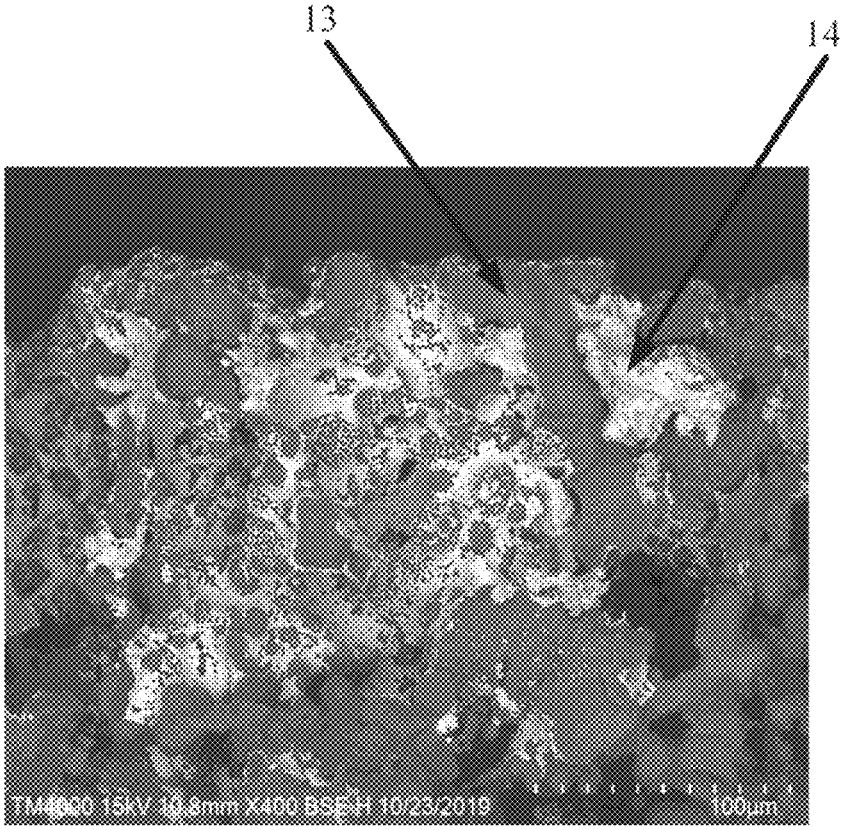
FIG. 10 is a microscopic morphology diagram of a cross section of a heating assembly according to this application under a scanning electron microscope.
Figure 11:
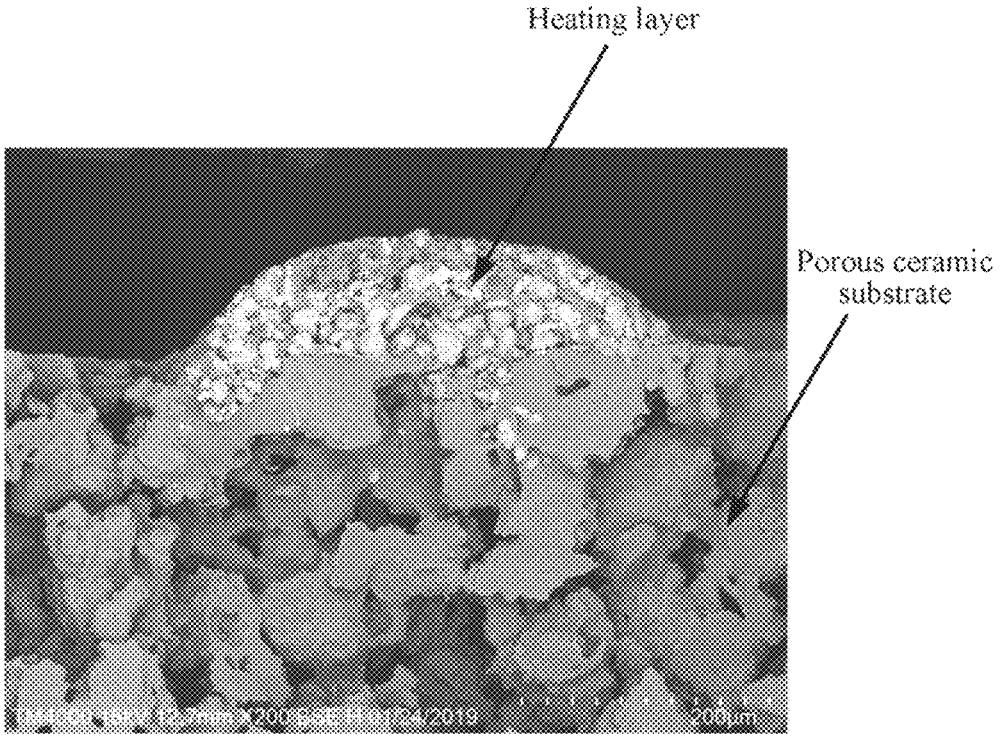
FIG. 11 is a microscopic morphology diagram of a cross section of a heating assembly in the prior art under a scanning electron microscope.

The porous ceramic substrate 13 is loaded into a silk-screen fixture, the conductive slurry is coated on the porous ceramic substrate 13 by means of screen printing, and then the preform that a portion of the heating layer 14 penetrates into of the heating assembly 11 of the porous ceramic substrate 13 by performing leveling, standing, and drying, that is, the heating layer 14 is formed on the surface of the porous ceramic substrate 13, as shown in FIG. 10 (FIG. 10 is a microscopic morphology diagram of a cross section of the heating assembly provided in this application under a scanning electron microscope). The sintered metal layer 14 is partially disposed in the porous ceramic substrate 13. Compared with the prior art, as shown in FIG. 11 (FIG. 11 is a microscopic morphology diagram of a cross section of a heating assembly in the prior art under a scanning electron microscope), the metal layer 14 is attached to the surface of the porous ceramic substrate 13, and does not penetrate into the porous ceramic substrate 13, so that infiltrability of the heating layer 14 and the porous ceramic substrate 13 is improved, and the heating layer 14 and the porous ceramic substrate 13 are integrated. In another implementation, a manner such as spraying, a physical vapor deposition process (PVD), or a chemical vapor deposition process (CVD) may be used, or a plurality of processes may be used in combination to prepare the heating layer 14. A specific process may be selected according to a requirement.

The leveling and standing time is at least 3 minutes, so as to ensure that the conductive slurry can fully penetrate into the interior of the porous ceramic by using the capillary force of the porous ceramic and the pulling action of the gravity of the conductive slurry, and form a structure in which the heating layer 14 partially penetrates into the porous ceramic substrate 13. The drying temperature is controlled at 30-70° C. and the drying time is 15 min-30 min. The drying temperature is greater than 30° C., to ensure that the solvent in the organic carrier in the conductive slurry can quickly volatilize, so that the conductive slurry solidifies. The drying temperature is less than 70° C., so as to prevent the viscosity of the conductive slurry from rapidly decreasing at a high temperature, causing that the fluidity of the conductive slurry increases, and a large quantity of the conductive slurry flows into the pores of the porous ceramic, which causes insufficient coverage of the slurry on the surface of the porous ceramic substrate 13, and further makes the resistance value of the heating layer 14 larger.

In an implementation, Ag, Pd, Pt, Au, Ru, and Ni are mixed to obtain a conductive powder, and D50 of the conductive powder is 3 microns. Using terpineol and butyl carbitol as the main solvent, ethyl cellulose as the thickener, hydrogenated castor oil as the flow control agent, and polyvinyl butyral as the surfactant, the organic carrier is obtained by mixing. The main solvent accounts for 85% of the total mass of the organic carrier, the thickener accounts for 8% of the total mass of the organic carrier, the flow control agent accounts for 4% of the total mass of the organic carrier, and the surfactant accounts for 3% of the total mass of the organic carrier. The conductive powder is mixed with the organic carrier to obtain the conductive slurry, where the viscosity of the conductive slurry is 100000 Pa·S. The percentage of the conductive powder in the total mass of the conductive slurry is 90%, and the percentage of the organic carrier in the total mass of the conductive slurry is 10%. The conductive slurry is coated on the porous ceramic substrate 13 by screen printing, and then is leveled and stood for 3 minutes, and dried at 60° C. to form the heating layer 14 having a porous structure on the surface of the porous ceramic substrate 13, and a portion of the heating layer 14 is filled in the porous ceramic substrate 13.

By using the preparation method for forming the heating layer 14 on the surface of the porous ceramic substrate 13 provided in this application, the heating layer 14 and the porous ceramic substrate 13 are combined as a whole, so that the to-be-vaporized substrate can infiltrate the entire heating layer 14.

S03: Form an electrode on the surface of the porous ceramic substrate, and obtain a heating assembly after sintering.

Figure 12:
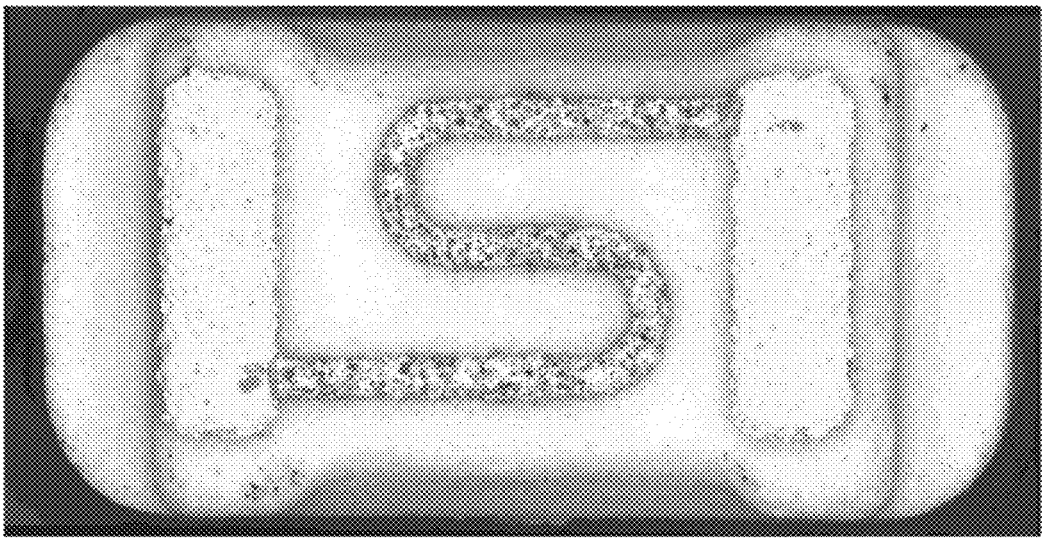
FIG. 12 is a schematic product diagram of a heating assembly according to this application.

An electrode slurry may be obtained. The electrode slurry may be a conductive slurry purchased from the market, or may be self-made. The preform of the heating assembly 11 is loaded into the silk-screen fixture, and the electrode slurry is coated on the porous ceramic substrate by means of screen printing. After silk-screen printing, the electrode slurry is leveled and stood for 5 minutes, and is dried at a temperature of 20° C.-200° C. for 10 min-30 min, so as to form two electrodes 15 on the porous ceramic substrate 13, and the two electrodes 15 are respectively connected to the head and tail ends of the heating layer 14. Then, the heating assembly 11 of this application is obtained by sintering at a temperature of 700° C.-1500° C., as shown in FIG. 12 (FIG. 12 is a schematic product diagram of the heating assembly according to this application). In another implementation, the electrode 15 may also be prepared in a manner such as spraying, a physical vapor deposition process (PVD), or a chemical vapor deposition process (CVD). A specific process may be selected according to a requirement.

The heating assembly in this application includes a porous ceramic substrate and a heating layer. The porous ceramic substrate is configured to guide a to-be-vaporized substrate, the heating layer is configured to heat to vaporize the to-be-vaporized substrate, the heating layer is a porous structure, and a portion of the heating layer is filled in the porous ceramic substrate. The heating layer is disposed as a porous structure, and the heating layer is partially filled in the porous ceramic substrate, to improve infiltrability of the porous ceramic substrate and the heating layer, so that the to-be-vaporized substrate contacts the heating layer more fully, which helps the heating layer transfer heat to the to-be-vaporized substrate around the heating layer in a timely manner, increases an aerosol amount, avoids phenomena such as dry burning, carbon deposition, and burning smell, and improves user experience.

The foregoing descriptions are merely some embodiments of this application, and the protection scope of this application is not limited thereto. All equivalent apparatus or process changes made according to the content of this specification and accompanying drawings in this application or by directly or indirectly applying this application in other related technical fields shall similarly fall within the patent protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A heating assembly, comprising:

a porous ceramic substrate configured to guide a to-be-vaporized substrate; and a heating layer configured to heat to vaporize the to-be-vaporized substrate, wherein the heating layer comprises a porous structure, wherein the heating layer is partially filled in the porous ceramic substrate, wherein a portion of the heating layer is filled in the porous ceramic substrate along a thickness direction, and another portion thereof is disposed outside the porous ceramic substrate, wherein a thickness of the portion of the heating layer that is disposed outside the porous ceramic substrate is 1-15 μm, and wherein a thickness of the portion of the heating layer that is filled into the porous ceramic substrate is 30-200 μm.

2. The heating assembly of claim 1, wherein a portion of the heating layer in the porous ceramic substrate is filled in a pore formed in the porous ceramic substrate such that a portion thereof is attached to a pore wall of the pore formed in the porous ceramic substrate.

3. The heating assembly of claim 1, wherein a porosity of the heating layer is 20%-60%.

4. The heating assembly of claim 1, wherein the heating layer comprises at least one of a metal, an alloy, and a conductive ceramic.

5. The heating assembly of claim 1, wherein a porosity of the porous ceramic substrate is 40%-75%, and an average pore size of the porous ceramic substrate is 10-40 μm.

6. The heating assembly of claim 1, further comprising:

two electrodes disposed at an interval on the porous ceramic substrate and configured to connect the heating layer to a battery, wherein resistance values of both of the two electrodes are less than 0.1Ω.

7. The heating assembly of claim 1, wherein a resistance value of the heating assembly is 0.5Ω-2.0Ω.

8. An electronic vaporization apparatus, comprising:

the heating assembly of claim 1.

9. A method for preparing a heating assembly, comprising:

obtaining a porous ceramic substrate; and forming a heating layer having a porous structure on a surface of the porous ceramic substrate, wherein the heating layer is specifically sintered using a conductive slurry, wherein the heating layer is partially filled in the porous ceramic substrate, wherein the conductive slurry comprises a conductive powder and an organic carrier, wherein the conductive powder comprises at least one of a metal, an alloy, and a conductive ceramic, wherein the organic carrier comprises a main solvent, a thickener, a flow control agent, and a surfactant, wherein a percentage of the conductive powder to a total mass of the conductive slurry is 50%-90%, and a percentage of the organic carrier to the total mass of the conductive slurry is 10%-50%, and wherein a viscosity of the conductive slurry is 10000 Pa·S-1000000 Pa·S.

10. The method for preparing the heating assembly of claim 9, wherein a percentage of the main solvent to a total mass of the organic carrier is 70%-90%, a percentage of the thickener to the total mass of the organic carrier is 0.5%-20%, a percentage of the flow control agent to the total mass of the organic carrier is 0.1%-10%, and a percentage of the surfactant to the total mass of the organic carrier is 0%-5%.

11. The method for preparing the heating assembly of claim 9, wherein a median particle size of the conductive powder is not greater than 5 μm.

12. The method for preparing the heating assembly of claim 9, wherein a sintering temperature is 700-1500° C.

* * * * *